United States Patent [19]

Blatt

[11] 4,449,745

[45] May 22, 1984

[54] TOGGLE ACTION JAW-TYPE GRIPPER

[76] Inventor: Leland F. Blatt, P.O. Box 220, Fraser, Mich. 48026

[21] Appl. No.: 348,945

[22] Filed: Feb. 16, 1982

[51] Int. Cl.[3] ..... B66C 1/42

[52] U.S. Cl. ..... 294/88

[58] Field of Search ..... 294/88, 104, 106, 115, 294/103 R, 118, 90, 86, 33, DIG. 2, 86 R; 414/22, 745, 739, 751, 753, 741, 728

[56] References Cited

U.S. PATENT DOCUMENTS 3,371,953 3/1968 Blatt ..... 294/88

3,410,431 11/1968 Vik ..... 294/88

*Primary Examiner*—James B. Marbert

*Attorney, Agent, or Firm*—Cullen, Sloman, Cantor, Grauer, Scott & Rutherford

[57] ABSTRACT

A toggle action jaw-type gripper guidably mounts between the side walls of its body a power reciprocated clevis. A pair of opposed L-shaped jaw spacers at their one ends are pivotally connected together and upon the jaw body. A pair of links at their one ends are pivoted to the clevis and at their other ends are pivotally connected respectively to the other ends of the jaw spacers. Each of the jaw spacers has a central jaw link projecting therefrom. A pair of jaw arms at their inner ends are nested within the jaw links respectively and selectively welded thereto at a predetermined included angle for a particular clamping function.

6 Claims, 9 Drawing Figures

79
83
83
75
75
67
67
59
69
77
77
73
73
51
55
63
61
53
61
41
45
39
43
21
31
17
21

79
83
79
81
83
11
75
75
75
75
59
59
73
63
85
69
32
61
53
55
57
63
39
43
45
25
27
11
21
23
27
17
15
13
49
47

FIG. 4
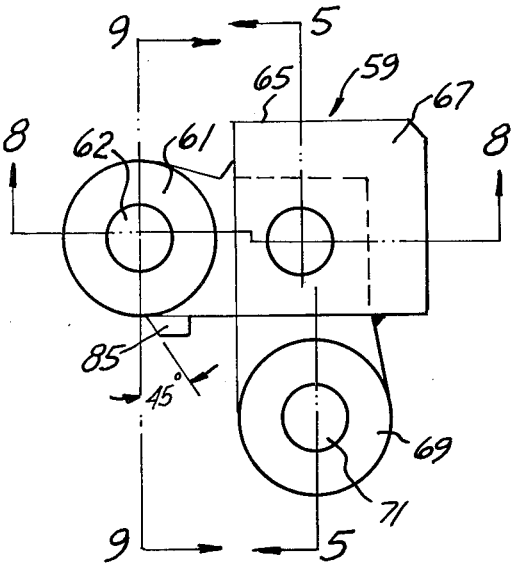
FIG. 6
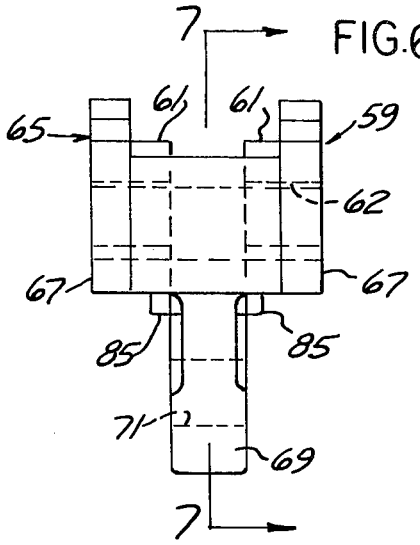
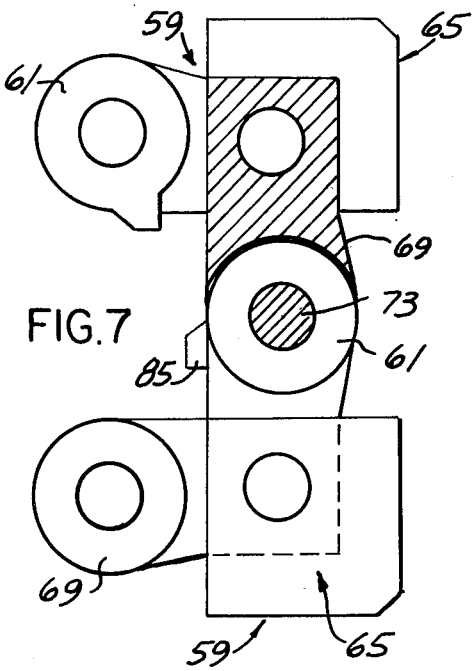
FIG. 7
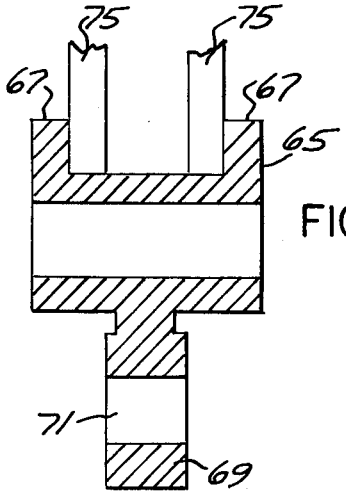
FIG. 5
FIG. 8
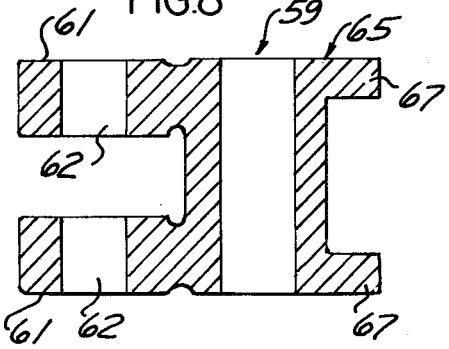
FIG. 9
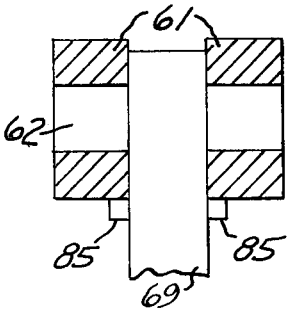

TOGGLE ACTION JAW-TYPE GRIPPER

BACKGROUND OF THE INVENTION

A toggle action jaw-type gripper is disclosed in the applicant's U.S. Pat. No. 3,371,953 issued Mar. 5, 1968. The problem with that construction was that the jaw arms employed form a part of the control linkage so that once assembled within the supporting body or housing are at a fixed included angle with respect to each other. This angle may not be suitable for all types of clamping specifications. In many cases it would be advantageous if the initial included angle between the jaw arms were variable so that the jaw arms need not be special jaws, but maybe set a predetermined included angle for certain specific application and welded in place.

SUMMARY OF THE INVENTION

It is an important feature of the present invention to provide an improved toggle action jaw-type gripper wherein there is pivotally mounted a pair of opposed pivotally interconnected jaw spacers controlled by reciprocal movements of a clevis slidably mounted within the jaw body and connected to the one ends of the jaw spacers by a pair of links. In the initial construction, the jaw arms are separate from the jaw spacers, and at point of use may be selectively positioned with respect to jaw spacers and welded thereto at a predetermined included angle for a particular clamping specification.

It is another feature to provide an improved jaw spacer assembly wherein a pair of symmetrical L-shaped jaw spacers are arranged in opposed relationship within the body of the jaw-type gripper at their one ends pivotally connected together and pivotally mounted upon the jaw body. The opposite ends of the jaw spacers are respectively connected by links to a reciprocal clevis mounted within the housing controlling reciprocal rotary movements of the respective jaw spacers.

A further feature provides a construction of the jaw spacers so as to have centrally thereof jaw links which project upwardly thereof and which include opposed side plates within which the ends of the preselected jaw arms may be positioned and welded thereto at a preselected included angle for a specific clamping application.

A further feature includes upon at least one of the jaw spacers a centrally arranged stop boss adapted for registry with the linkage between the clevis and the jaw spacers for preventing the pivotal connection of the clevis with the links from moving past dead center of a line between the pivotal connections between the links and the corresponding jaw spacers to prevent the jaw from locking in clamping position.

A further feature provides for a unitary body including a mount flange at one end and a pair of parallel spaced side plates with a mounting flange adapted for registry and securing to a corresponding mounting flange upon a cylinder assembly actuating unit including a piston rod end adapted for connection with the clevis for reciprocating the clevis and in turn causing the jaw arms to close and open with respect to a workpiece.

These and other objects and features will be seen from the following specifications and claims in conjunction with the appended drawings.

DRAWINGS

FIG. 4 is a side elevational view of the upper jaw spacer shown in FIG. 1.

FIG. 5 is a section taken in the direction of arrows 5—5 of FIG. 4.

FIG. 6 is an end elevational view thereof.

FIG. 7 is a section taken in the direction of arrows 7—7 of FIG. 6 and further illustrating the connection of the lower jaw spacer thereto as shown in FIG. 1.

FIG. 8 is a section taken in the direction of arrows 8—8 of FIG. 4.

FIG. 9 is a section taken in the direction of arrows 9—9 of FIG. 4.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
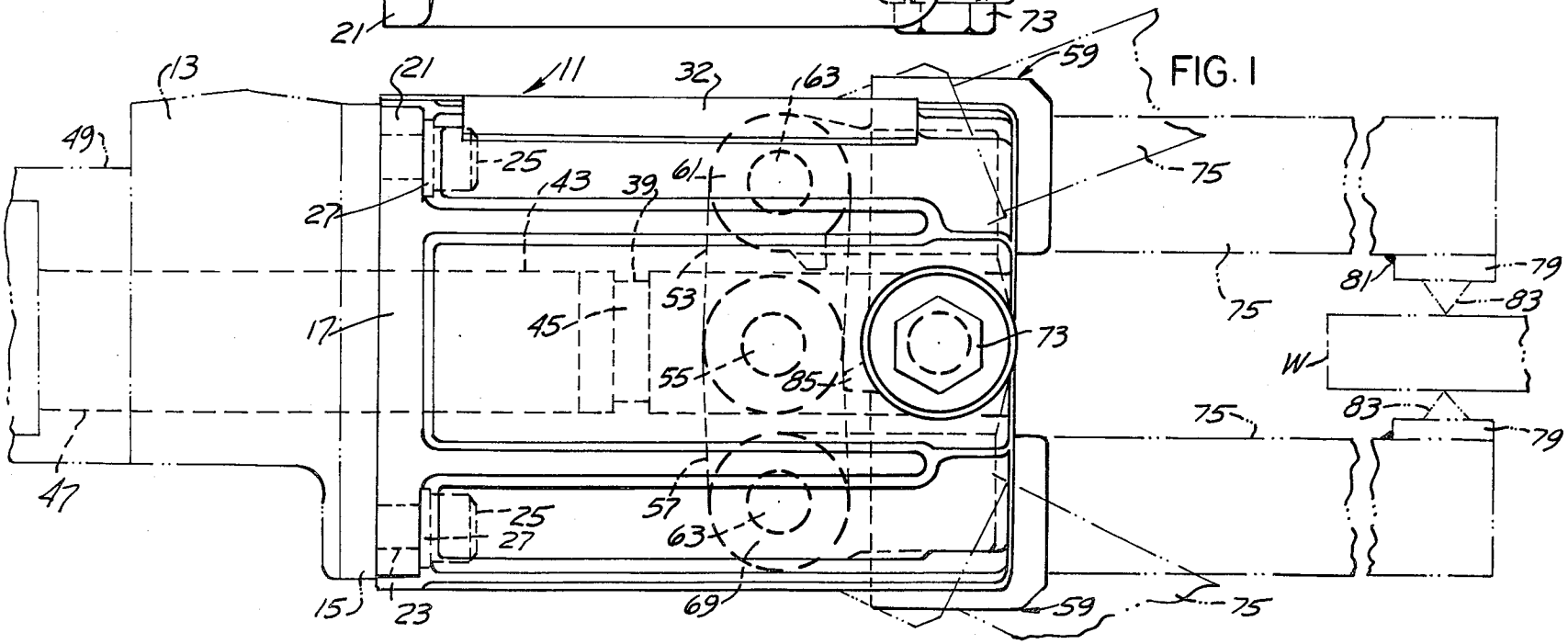
FIG. 1 is a fragmentary side elevational view of the present toggle action jaw pipe gripper with the jaw arms fragmentarily shown and in gripping engagement with a workpiece.

The present toggle action jaw-type gripper is generally indicated at 11 in FIG. 1 and at one end is connected to and mounted upon actuating unit 13 framentarily shown, which includes a cylinder assembly 49 and an apertured mount flange 15.

Figure 2:
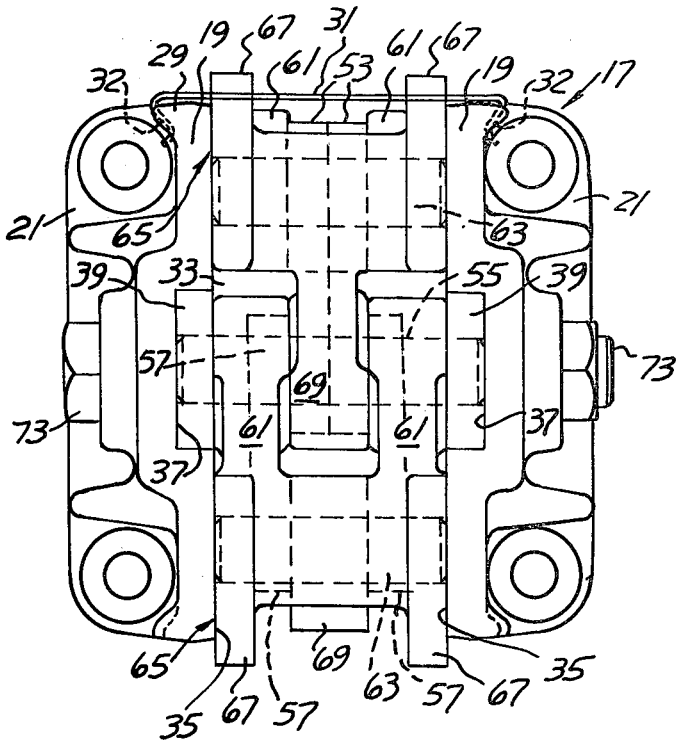
FIG. 2 is a right end elevational view thereof.

The jaw body 17, FIG. 2 includes a pair of opposed parallel side plates 19 extending at right angles from mount flange 21, FIG. 1 apertured at 23 and secured to actuating unit mount flange 15 by a plurality of cap screws 25 including lock washers 27.

Each of the side plates includes an outwardly directed elongated top flange 29 over which is removably snapped or mounted cover clip 31 of spring steel. Said cover clip along its sides has opposed outwardly directed flexible side flanges 32 which cooperatively project over side wall top flanges 29 for securing the cover clip in position for protectively enclosing chamber 33 between said side walls within said body.

Figure 3:
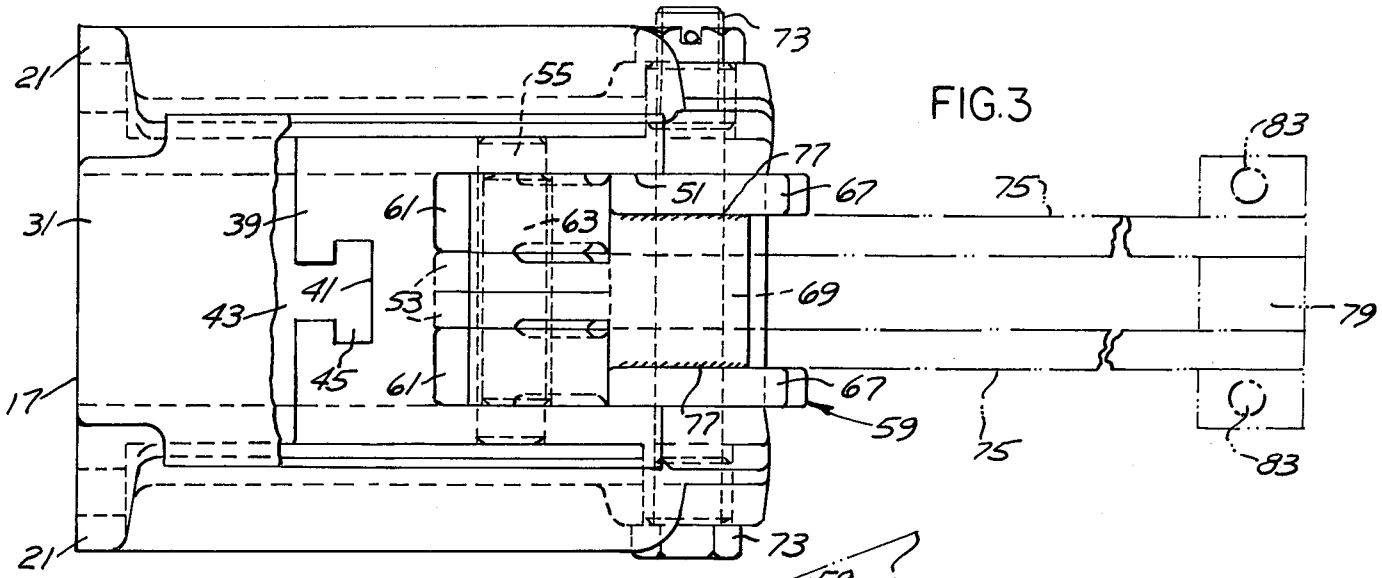
FIG. 3 is a plan view thereof.

Each of the side plates have interior side walls 35 defining chamber 33, there being opposed undercut longitudinal slots 37 formed within said side walls for supportably receiving reciprocal clevic 39, FIG. 3. Said clevis has at one end a T-slot 41, FIG. 3 adapted to receive the T connector 45 of rod end 43 forming a part of the cylinder assembly 49. The cylinder assembly includes piston rod 47 which terminates in the rod end 43 as a part thereof or is axially connected thereto, so that the piston rod 47 and rod end 43 reciprocate in unison under the control of the cylinder 49.

A pair of engaging substantially upright upper links 53 extend into the central clevic slot 51 and are pivotally connected thereto by pivot pin 55 upon a first axis which coincides with the longitudinal axis of the rod end 43. A pair of substantially upright lower links 57 are arranged upon the outsides of the upper links 53, likewise extend into the clevis slot 51, and are pivotally connected to the clevis by the same transverse pivot pin 55 along said first axis.

A pair of opposed L-shaped jaw spacers 59 of L-shape, FIGS. 4–9, each have a pair of trunions 61 transversely apertured at 62, and at their other end a pivot arm 69 transversely apertured at 71. The upper links 53 at their outer ends extend between the pair of trunions 61 of the upper jaw spacer 59 and are pivotally connected thereto by the transverse pivot pin 63 arranged upon a second axis parallel to the first axis of the pivot pin 55.

Upon assembly, FIG. 7, apertured pivot arm 69 of the upper jaw spacer 59 is assembled with respect to the pair of trunions 61 of the lower jaw spacer 59 and are pivotally interconnected by pivot bolt 73 which spans and extends through corresponding apertures in the body side plates 19 and is secured thereto as shown in FIG. 3.

The respective opposed jaw spacers 59 are oppositely arranged so that apertured pivot arm 69 of the upper jaw spacer is pivotally connected to the apertured trunions 61 of the lower jaw spacer upon an axis which is parallel to the first axis 55.

The outer ends of the lower links 57 receive the apertured pivot arm 69 of the lower jaw spacer and are pivotally connected thereto by the transverse pivot pin 63 on a third transverse axis parallel to the axes 55 and 63. With respect to the pair of opposed spaced oppositely arranged jaw spacers 59, each thereof have at one end spaced aperture trunions 61 and at their opposite ends apertured pivot arm 69.

As best shown in FIG. 2 it appears that pivot arm 69 of the upper jaw spacer 59 extends into the trunions 61 of the lower jaw spacer. Thus the trunnions 61 of one jaw spacer are pivotally connected to one pair of links and the pivot arm of the other jaw spacer is pivotally connected to the other pair of links shown in FIGS. 1,2 and 3.

The detail of construction of the jaw spacers, 59 is illustrated in FIGS. 4–9. Intermediate the ends and centrally of each of the jaw spacers 59 are the apertured projecting jaw links 65 which include opposed pairs of side plates 67.

A pair of jaw arms 75 of FIGS. 1 and 3, at their one ends extend into the jaw body 17 and extend into the respective jaw links 65 between the side plates 67 and are secured thereto as by the welds 77. In the illustrative embodiment shown in FIG. 3 there are a pair of upper jaw arms 75 and a pair of lower jaw arms 75 which individually extend within the corresponding jaw links and are welded to the corresponding side plates 67 thereof as by the welds 77.

Since the initial included angle between the jaw arms 75 shown in dash lines varies depending upon the intended use and clamping function of the jaw arms with respect to workpiece W, the jaw arms 75 are initially supplied separately or are provided by the user and are arranged at the desired included angle, FIG. 1, between the sets of upper and lower jaw arms and then affixed to the corresponding jaw links 65.

In the illustrated embodiment, utilizing two upper jaw arms and two lower jaw arms, a transverse mount plate 79 spans the upper and lower jaw arms respectively and is suitably secured thereto as by the welds 81. Transverse spaced grip points 83 project from the inner faces of the mount plates 79 and are adapted for operative engagement with workpiece W, fragmentarily shown, when the jaws have been moved to the closed position shown in FIG. 1. The dashed line position of the arms 75 in FIG. 1 shows the relative positions of the jaw arms when the clevis has been retracted for releasing the workpiece W.

Stop boss 85 projects rearwardly of the trunions 61, such as shown in FIG. 9, and when assembled in FIG. 1 are shown limiting forward advancing movement of the clevis 39. The stop bosses 85 bear against the corresponding links 57 to prevent the pivot pin 55 from moving across dead center with respect to the pivot pins 63. This prevents the toggle linkage from locking in the advanced position shown in FIG. 1. With pressure on the jaws, the linkage is closed on the blind end of the cylinder which has relatively more area than the rod side of the piston. Since the same pressure is used, if the linkage assembly were allowed to cross center, it would lock in the closed position.

In the present construction, the opposed pair of jaw spacers 59 are symmetrical and interchangeable between upper and lower jaws and their use facilitates and simplifies the manufacture of special jaws as they now under the construction may be made to fit certain specific applications and welded on the jaw spacers as required with the correct included angularity between them defined for the retracted dash line position thereof. Should the jaw arms be damaged, they may be replaced with another set welded on.

In the illustrated embodiment there is shown in FIG. 3 the pair of jaw arms 75 corresponding to the upper jaws for which there would be a corresponding pair of jaw arms for the lower jaws as shown in FIG. 1. It is contemplated that the pair of jaw arms 75 shown in FIG. 3 could be replaced by a single jaw arm and likewise the lower jaw arms could be replaced by a single jaw arm which would have attached the workpiece securing points 83 for securing the workpiece W in the same manner as shown in FIG. 1.

The present toggle action jaw-type gripper represents a substantial improvement over Leland F. Blatt U.S. Pat. No. 3,371,953 dated Mar. 5, 1968 entitled "Gripper". There is an improved body and housing construction and an improved linkage as well as an improved arrangement for the jaw arms where the jaw arms are separate from the toggle action clevis operated jaw spacers herein in the present construction. Instead of limiting the jaws to a particular arrangement they are made separate from the jaw spacers and can be secured at point of use to the jaw spacers at the correct included angle depending upon the clamping specification for a particular case. There is an improvement therefore in the construction of the housing, mounting of the clevis, arrangement of the jaw spacers pivotally mounted upon the housing and to which the jaw arms may be selectively secured and welded as disired.

Having described my invention, reference should now be had to the following claims: I claim:

1. A toggle action jaw-type gripper comprising:

a hollow jaw body including an apertured mount flange at one end adapted for connection to an actuating unit having a projecting reciprocal rod end, and a pair of parallel spaced opposed side plates; there being opposed undercut guide slots formed upon the interior of said side plates longitudinally thereof;

an apertured clevis within said body slidably mounted and supported within said guide slots for reciprocal movements, and adapted for connection to said rod end;

a pair of opposed jaw spacers of L-shape, each jaw spacer having spaced apertured trunions at one end and a central apertured pivot arm at its other end;

the trunions of one jaw spacer being assembled over and receiving the pivot arm of the other jaw spacer;

a pivot bolt supportably extending through said assembled trunions and pivot arm extending transversely through and spanning said side plates and secured thereto, providing a pivot mounting for said jaw spacers;

the respective other jaw arm and trunions of said jaw spacers extending rearwardly of said pivot bolt and spaced from said clevis;

first link at one end pivotally connected to said clevis upon a first transverse axis, and at its other end pivotally connected to the trunions of one of said jaw spacers upon a second transverse axis;

a second link at its one end pivotally connected to said clevis along said first axis, and at its other end pivotally connected to the pivot arm of the other jaw spacer upon a third transverse axis;

a jaw link mounted upon each jaw spacer intermediate its ends;

and a pair of opposed spaced jaw arms at their one ends extending into said body, selectively nested within said jaw links respectively at a preselected included angle and welded thereto; the other ends of said jaw arms when brought together on movement of said clevis in one direction adapted to retainingly secure a workpiece therebetween.

2. A toggle action jaw-type gripper comprising:

a hollow jaw body including an apertured mount flange at one end adapted for connection to an actuating unit having a projecting reciprocal rod end, and a pair of parallel spaced opposed side plates; there being opposed undercut guide slots formed upon the interior of said side plates longitudinally thereof;

an apertured clevis within said body slidably mounted and supported within said guide slots for reciprocal movements, and connected to said rod end;

a pair of opposed jaw spacers of L-shape, each jaw spacer having spaced apertured trunions at one end and a central apertured pivot arm at its other end;

the trunions of one jaw spacer being assembled over and receiving the pivot arm of the other jaw spacer;

a pivot bolt supportably extending through said assembled trunions and pivot arm extending transversely through and spanning said side plates and secured thereto, providing a pivot mounting for said jaw spacers;

the respective other jaw arm and trunions of said jaw spacers extending rearwardly of said pivot bolt and spaced from said clevis;

a pair of engaging first links at their one ends extending into and pivotally connected to said clevis upon a first transverse axis, and at their other ends extending into the trunions of one of said jaw spacers and pivotally connected thereto upon a second transverse axis;

a pair of second links bearing against and outwardly of said first links respectively, at their one ends projected into and pivotally connected to said clevis along said first axis, and at their other ends bearing against and pivotally connected to the pivot arm of the other jaw spacer upon a third transverse axis;

a jaw link mounted upon each jaw spacer intermediate its ends;

and a pair of opposed spaced jaw arms at their one ends extending into said body, selectively nested within said jaw links respectively at a preselected included angle and welded thereto; the other ends of said jaw arms when brought together on movement of said clevis in one direction adapted to retainingly secure a workpiece therebetween.

3. In the jaw-type gripper of claim 1, the upper longitudinal edges of said side plates including elongated lateral flanges; and a resilient removable cover clip spanning said side plates having flexible side flanges yieldably positioned over said side wall flanges and secured thereto.

4. In the jaw-type gripper of claim 1, the jaw links including a pair of laterally spaced side plates receiving the one ends of said jaw arms.

5. In the jaw-type gripper of claim 1, a stop boss mounted upon one of said jaw spacers adjacent said pivot bolt in the path of movement of said links at said clevis preventing the pivotal connection of said links with said clevis from passing dead center with respect to the pivot mounting of said links with said jaw spacers.

6. In a toggle action jaw-type gripper having a hollow jaw body including an apertured mount flange at one end adapted for connection to an actuating unit having a projecting reciprocal rod end, and a pair of parallel spaced opposed side plates; there being opposed undercut guide slots formed upon the interior of said side plates longitudinally thereof; an apertured clevis within said body slidably mounted and supported within said guide slots for reciprocal movements, and adapted for connection to said rod end; the improvement comprising:

a pair of opposed jaw spacers of L-shape, each jaw spacer having spaced apertured trunions at one end and a central apertured pivot arm at its other end;

the trunions of one jaw spacer being assembled over and receiving the pivot arm of the other jaw spacer;

a pivot bolt supportable extending through said assembled trunions and pivot arm extending transversely through and spanning said side plates and secured thereto, providing a pivot mounting for said jaw spacers;

the respective other jaw arm and trunions of said jaw spacers extending rearwardly of said pivot bolt and spaced from said clevis;

a first link at one end pivotally connected to said clevis upon a first transverse axis, and at its other end pivotally connected to the trunions of one of said jaw spacers upon a second transverse axis;

a second link at its one end pivotally connected to said clevis along said first axis, and at its other end pivotally connected to the pivot arm of the other jaw spacer upon a third transverse axis;

a jaw link mounted upon each jaw spacer intermediate its ends;

and a pair of opposed spaced jaw arms at their one ends extending into said body, selectively nested within said jaw links respectively at a preselected included angle and welded thereto; the other ends of said jaw arms when brought together on movement of said clevis in one direction adapted to retainingly secure a workpiece therebetween.

* * * * *